US009153090B2

(12) United States Patent
Pacey et al.

(10) Patent No.: US 9,153,090 B2
(45) Date of Patent: Oct. 6, 2015

(54) SYMBOL PUSHING GAMING MACHINE

(75) Inventors: Larry J. Pacey, Northbrook, IL (US); Alfred Thomas, Las Vegas, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 2625 days.

(21) Appl. No.: 11/791,815

(22) PCT Filed: Dec. 7, 2005

(86) PCT No.: PCT/US2005/044727

§ 371 (c)(1), (2), (4) Date: May 29, 2007

(87) PCT Pub. No.: WO2006/063290

PCT Pub. Date: Jun. 15, 2006

(65) Prior Publication Data

US 2008/0125209 A1 May 29, 2008

Related U.S. Application Data

(60) Provisional application No. 60/635,334, filed on Dec. 10, 2004, provisional application No. 60/693,377, filed on Jun. 23, 2005.

(51) Int. Cl.
*G07F 17/34* (2006.01)
*G07F 17/32* (2006.01)

(52) U.S. Cl.
CPC ..... *G07F 17/32* (2013.01); *G07F 17/3244* (2013.01)

(58) Field of Classification Search
USPC ..... 462/20
See application file for complete search history.

(56) References Cited

U.S. PATENT DOCUMENTS

| | | | | |
|---|---|---|---|---|
| 5,833,537 | A | 11/1998 | Barrie | 463/21 |
| 5,971,849 | A * | 10/1999 | Falciglia | 463/16 |
| 5,976,016 | A | 11/1999 | Moody et al. | 463/13 |
| 6,056,642 | A | 5/2000 | Bennett | 463/20 |
| 6,251,013 | B1 | 6/2001 | Bennett | 463/13 |

(Continued)

FOREIGN PATENT DOCUMENTS

| | | | | |
|---|---|---|---|---|
| GB | 2092797 | A | 8/1982 | G07F 17/34 |
| GB | 2096376 | A | 10/1982 | G07F 17/34 |

(Continued)

OTHER PUBLICATIONS

International Application No. PCT/US05/44727, Search Report dated Oct. 30, 2006 (4 pages).

(Continued)

*Primary Examiner* — Kang Hu
*Assistant Examiner* — Syvila Weatherford
(74) *Attorney, Agent, or Firm* — Nixon Peabody LLP

(57) ABSTRACT

A gaming machine for conducting a symbol pushing wagering game (40) includes a plurality of symbols (42) arranged in an array (44). The array (44) comprises at least one variable position (52) and a plurality of pass-through positions (54). At least one pass-through position is adjacent to the variable position. A first symbol in the variable position is varied and then stopped, wherein the first symbol is translated from the variable position to the adjacent pass-through position. In the direction of translation, symbols are pushed to adjacent pass-through positions. Payoff awards are distributed upon the occurrence of certain winning combination of symbols.

21 Claims, 9 Drawing Sheets

(56) References Cited

U.S. PATENT DOCUMENTS

| | | | | |
|---|---|---|---|---|
| 6,270,411 | B1 | 8/2001 | Gura et al. | 463/20 |
| 6,494,785 | B1 | 12/2002 | Gerrard et al. | 463/20 |
| 6,565,433 | B1 | 5/2003 | Baerlocher et al. | 463/20 |
| 6,645,073 | B2 | 11/2003 | Lemay et al. | 463/20 |
| 6,702,675 | B2 * | 3/2004 | Poole et al. | 463/31 |
| 6,731,313 | B1 | 5/2004 | Kaminkow | 345/839 |
| 6,739,971 | B2 | 5/2004 | Devaull | 463/20 |
| 6,837,790 | B1 | 1/2005 | Kaminkow | 463/31 |
| 6,910,962 | B2 | 6/2005 | Marks et al. | 463/16 |
| 6,918,832 | B2 | 7/2005 | Baerlocher et al. | 463/20 |
| 6,981,635 | B1 | 1/2006 | Hughs-Baird et al. | 463/20 |
| 7,104,888 | B2 | 9/2006 | Miereau et al. | 463/20 |
| 7,144,322 | B2 | 12/2006 | Gomez et al. | 463/20 |
| 7,182,690 | B2 | 2/2007 | Giobbi et al. | 463/24 |
| 2003/0186737 | A1 | 10/2003 | Bennett et al. | 463/20 |
| 2004/0033829 | A1 | 2/2004 | Pacey et al. | 463/20 |
| 2004/0043809 | A1 | 3/2004 | Gomez et al. | 463/16 |
| 2004/0048650 | A1 * | 3/2004 | Mierau et al. | 463/20 |
| 2004/0097280 | A1 | 5/2004 | Gauselmann | 463/16 |
| 2004/0209662 | A1 | 10/2004 | Wadleigh | 463/16 |
| 2004/0229679 | A1 | 11/2004 | Anderson et al. | 463/20 |
| 2004/0242315 | A1 | 12/2004 | Paulsen et al. | 463/20 |
| 2005/0049030 | A1 | 3/2005 | Tachikawa | 463/20 |
| 2005/0054420 | A1 * | 3/2005 | Cregan et al. | 463/20 |
| 2005/0282607 | A1 | 12/2005 | Gauselmann | 463/16 |
| 2006/0058097 | A1 | 3/2006 | Berman et al. | 463/20 |
| 2006/0063588 | A1 | 3/2006 | Poole | 463/25 |
| 2006/0068881 | A1 * | 3/2006 | Casey | 463/20 |

FOREIGN PATENT DOCUMENTS

| | | | | |
|---|---|---|---|---|
| GB | 2097160 A | 10/1982 | | G07F 17/34 |
| GB | 2119991 A | 11/1983 | | G07F 17/34 |
| GB | 2137392 A | 10/1984 | | G07F 17/34 |
| GB | 2242300 A | 9/1991 | | G07F 17/34 |
| GB | 2367939 A | 4/2002 | | G07F 17/34 |
| GB | 2383668 A | 7/2003 | | G07F 17/34 |
| WO | WO 2006/009658 | 1/2006 | | A63F 13/00 |
| WO | WO 2006/076294 | 7/2006 | | |
| WO | WO 2007/002935 | 1/2007 | | A63F 9/24 |
| WO | WO 2007/130443 | 11/2007 | | A63F 13/06 |

OTHER PUBLICATIONS

International Application No. PCT/US05/44727, Written Opinion dated Oct. 30, 2006 (3 pages).

* cited by examiner

SYMBOL PUSHING GAMING MACHINE

CROSS-REFERENCE TO RELATED APPLICATION

This application is a U.S. national phase of International Application No. PCT/US2005/044727, filed Dec. 7, 2005, which claims the benefit of priority of U.S. Provisional Patent Application No. 60/635,334, filed Dec. 10, 2004, and U.S. Provisional Application No. 60/693,377, filed Jun. 23, 2005, both of which are incorporated by reference in their entirety.

FIELD OF THE INVENTION

The present invention relates generally to gaming machines and, more particularly, to a symbol pushing gaming machine having a plurality of symbols arranged in an array in which at least one symbol is varied and translated to cause other symbols in the array to be pushed into new positions.

BACKGROUND OF THE INVENTION

Gaming machines, such as slot machines, video poker machines and, the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines. Shrewd operators consequently strive to employ the most entertaining and exciting machines available because such machines attract frequent play and hence increase profitability to the operator.

One concept which has been successfully employed to enhance the entertainment value of a game is the concept of a "secondary" or "bonus" game which may be played in conjunction with a "basic" game. The bonus game may comprise any type of game, either similar to or completely different from the basic game, which is entered upon the occurrence of a selected event or outcome of the basic game. Generally, bonus games provide a greater expectation of winning than the basic game and may also be accompanied with more attractive or unusual video displays and/or audio. Because the bonus game concept offers tremendous advantages in player appeal and excitement relative to other known games, and because such games are attractive to both players and operators, there is a continuing need to develop gaming machines with new types of bonus games to satisfy the demands of players and operators.

Gaming machines have utilized a variety of mechanisms to present various combinations of symbols, and award prizes, money, or other awards associated with certain predefined winning combinations. Traditional slot machines, for example, utilize a plurality of reels and at least one payline, with certain combination of symbols landing on the payline constituting winning combinations for which awards are given to the player. Other gaming machines have arranged reels into a two dimensional array such that each symbol is varied (by being on an individual reel), and again awarding prizes to certain winning combinations. However, traditional uses of symbols arranged in arrays have limited entertainment value in that symbols are varied or re-spun with each play of the gaming machine. Furthermore, winning combinations on these traditional gaming machines are instantly removed or erased with each subsequent play of the gaming machine, denying the player additional winning opportunities and added excitement during play. Thus, a need exists for a gaming machine having symbols arranged in an array whereby a winning combination of symbols in the array persists, and is pushed, slid, or otherwise translated through the array to give a player of the gaming machine additional winning opportunities and added entertainment. The present invention is directed to satisfying these needs and solving other problems.

SUMMARY OF THE INVENTION

In accordance with the foregoing, a gaming machine for conducting a wagering game includes a primary display for displaying the wagering game. The gaming machine is controlled by a processor. The primary display displays the play of at least the basic game of the gaming machine. The primary display of the gaming machine displays a plurality of symbols arranged in an array. According to one aspect of the invention, the array is two dimensional with symbols arranged in rows and columns, the array comprising a plurality of positions.

According to another aspect of the invention, certain positions within the array are variable positions where symbols are varied randomly during subsequent plays of the game, while other positions are pass-through positions through which symbols are pushed or translated.

According to yet another aspect of the invention, symbols stopping, landing, or appearing within the variable positions of the array are translated, or pushed, a predetermined number of positions in the array along at least one of a row or column of the array.

According to yet another aspect of the invention, the variable positions of the array are aligned and the symbols are translated, or pushed, in a direction intersecting the line the variable positions. Preferably, the variable positions comprise an entire row of the array, and the symbols are pushed in the direction of the columns.

According to yet another aspect of the invention, translated or pushed symbols displace all other symbols in the direction of translation. Symbols on the exterior boundaries of the array which are displaced or pushed are removed from the primary display.

According to yet another aspect of the invention, the player is awarded repeatedly for winning combinations which have been translated or pushed to a new location in the array, which continue to constitute a winning combination.

Additional aspects of the invention will be apparent to those of ordinary skill in the art in view of the detailed description of various embodiments, which is made with reference to the drawings, a brief description of which is provided below.

DETAILED DESCRIPTION

Figure 1:
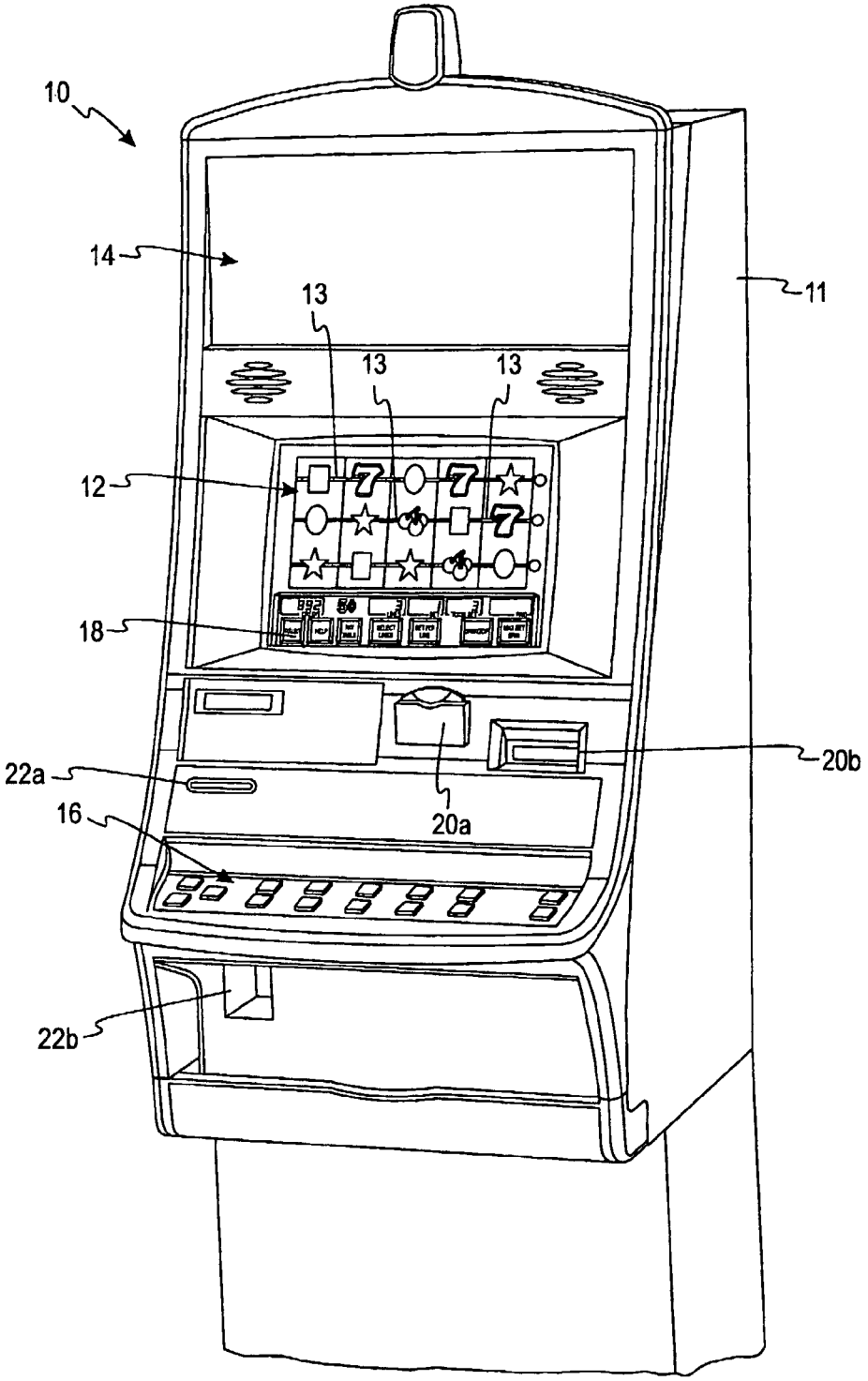
FIG. 1 is a perspective view of the gaming machine of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, etc.

The gaming machine 10 comprises a housing 11 and includes input devices, including a value input device 20 and a player input device 16. For output the gaming machine 10 includes a primary display 12 for displaying information about the basic wagering game. The primary display 12 can also display information about a bonus wagering game and a progressive wagering game. The gaming machine 10 may also include a secondary display 14 for displaying game events, game outcomes, and/or signage information. While these typical components found in the gaming machine 10 are described below, it should be understood that numerous other elements may exist and may be used in any number of combinations to create various forms of a gaming machine 10.

The value input device 20 may be provided in many forms, individually or in combination, and is preferably located on the front of the housing 11. The value input device 20 receives currency and/or credits which are inserted by a player. The value input device 20 may include a coin acceptor 20*a* for receiving coin currency (see FIG. 1). Alternatively, or in addition, the value input device 20 may include a bill acceptor 20*b* for receiving cash. Furthermore, the value input device 20 may include a ticket reader, or barcode scanner, for reading information stored on a credit ticket, a card, or other tangible portable credit storage device. The credit ticket or card may also authorize access to a central account, which can transfer money to the gaming machine 10.

The player input device 16 comprises a plurality of push buttons on a button panel for operating the gaming machine 10. In addition, or alternatively, the player input device 16 may comprise a touch screen mounted by adhesive, tape, or the like over the primary display 12. The touch screen contains soft touch keys 18 denoted by graphics on the underlying primary display 12 and used to operate the gaming machine 10. The touch screen provides players with an option on how to make their game selections. A player enables a desired function either by touching the touch screen at an appropriate touch key 18 or by pressing an appropriate push button 16 on the button panel. The touch keys 18 may be used to implement the same functions as push buttons 16. Alternatively, the push button panel 16 may provide inputs for one aspect of the operating the game, while the touch screen keys 18 may allow for input needed for another aspect of the game.

The various components of the gaming machine 10 may be connected directly to, or contained within, the housing 11, as seen in FIG. 1, or may be located outboard of the housing 11 and connected to the housing 11 via a variety of different connection methods well known in the art, including network connections, wireless connections, or other hardwired or remote connections. Thus, the gaming machine 10 comprises these components whether housed in the housing 11, or outboard of the housing 11 and connected remotely. Preferably, the primary display 12, secondary display 14, value input device 20, player input device 16, and body 40 of the gaming machine 10 are visible from outside of the housing 11 of the gaming machine 10, as seen in FIG. 1.

The operation of the basic wagering game is displayed to the player on the primary display 12. The primary display 12 can also display the bonus game associated with the basic wagering game. The primary display 12 may take the form of a cathode ray tube (CRT), a high resolution LCD, a plasma display, an LED, or any other type of video display suitable for use in the gaming machine 10. As shown, the primary display 12 includes the touch screen overlaying the entire monitor (or a portion thereof) to allow players to make game-related selections. Alternatively, the gaming machine 10 may have a number of mechanical reels to display the outcome. In the illustrated embodiment, the gaming machine 10 is an "upright" version in which the primary display 12 is oriented vertically relative to the player. Alternatively, the gaming machine may be a "slant-top" version in which the primary display 12 is slanted at about a thirty-degree angle toward the player of the gaming machine 10.

A player begins play of the basic wagering game by inserting a wager input into the value input device 20 of the gaming machine 10. A player can select play by using the player input device 16 or the touch screen keys 18. The basic game consists of a plurality of symbols arranged in an array, and includes at least one payline 13, yielding a plurality of outcomes of the basic game. Such outcomes are randomly selected in response to the wagering input by the player. At least one of the plurality of randomly-selected outcomes is a start-bonus outcome, which can include any variations of symbols or symbol combinations triggering a bonus game.

Figure 2:
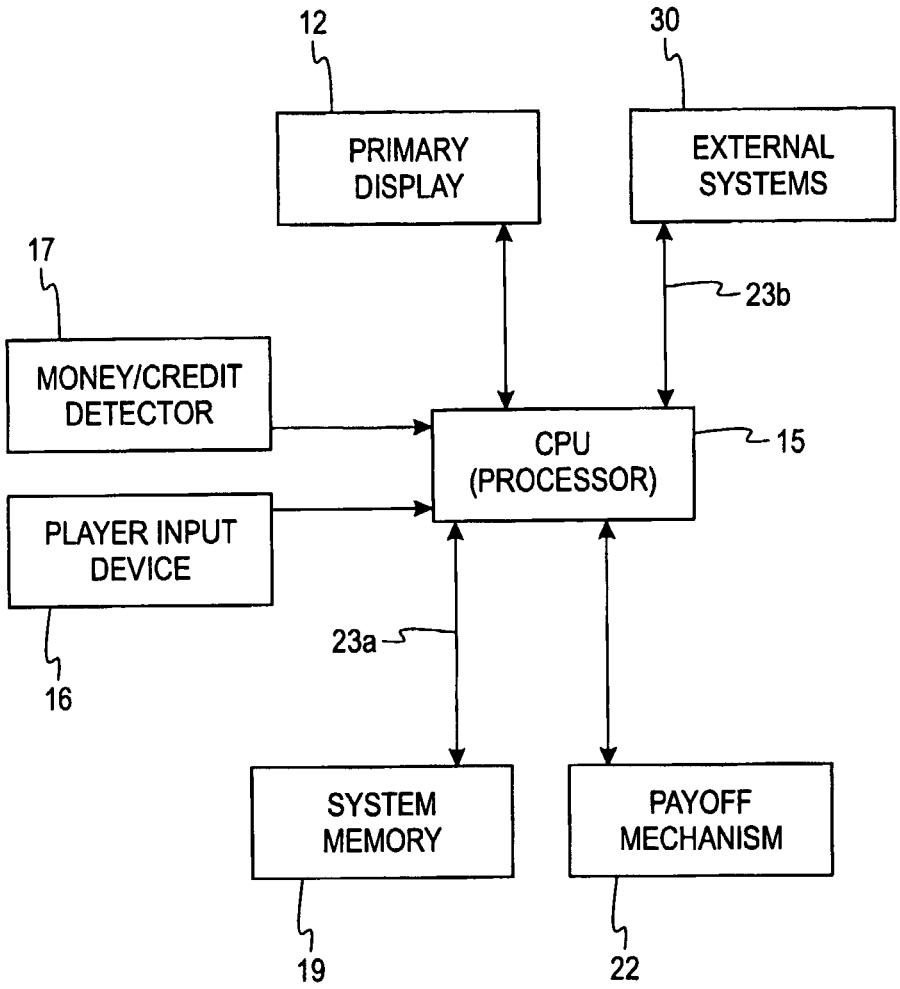
FIG. 2 is a block diagram of a control system suitable for operating the gaming machine of FIG. 1.

Turning now to FIG. 2, the various components of the gaming machine 10 are controlled by a central processing unit (CPU) 15, also referred to as a processor or controller (such as a microprocessor or microcontroller). To provide gaming functions, the processor 15 executes one or more game programs. The processor 15 performs the random selection (using a random number generator (RNG)) of an outcome from the plurality of outcomes of the wagering game. Alternatively, the random event may be generated remotely at a remote computer. The remote computer may use either an RNG or pooling schema for its central determination of a game outcome. It should be appreciated that the processor 15 may include one or more microprocessors, including but not limited to a master processor, a slave processor, and a secondary or parallel processor.

The processor 15 is also coupled to or includes a system memory 19 and a money/credit detector 17. The system memory 19 may comprise a volatile memory (e.g., a random-access memory (RAM)) and a non-volatile memory (e.g., an EEPROM). The money/credit detector 17 signals the processor that money and/or credits have been input via the value input device 20. The system memory 19 may include multiple RAM and multiple program memories. Preferably, these components are located within the housing 11 of the gaming machine 10 and not visible externally. However, as explained above, these components may be located outboard of the housing 11 and connected to the remainder of the components of the gaming machine 10 via a variety of different connection methods well known in the art, including network connections, wireless connections, or other hardwired or remote connections.

As seen in FIG. 2, the processor 15 is also connected to, and controls, the primary display 12, the player input device 16, and a payoff mechanism 22. The payoff mechanism 22 is operable in response to instructions from the processor 15 to award a payoff to the player in response to certain winning outcomes that might occur in the basic or the bonus game. The payoff may be provided in the form of points, bills, tickets, coupons, cards, etc. For example, in FIG. 1, the payoff mechanism 22 includes both a ticket printer 22*a* and a coin outlet 22*b*. However, any of a variety of pay off mechanisms 22 well known in the art may be implemented, including cards, coins, tickets, smartcards, cash, etc. The pay off amounts distributed by the payoff mechanism 22 are determined by one or more pay tables stored in the system memory 19.

Communications between the peripheral components of the gaming machine 10 and the processor 15 occur through input/output (I/O) circuits 23*a*. As such, the processor 15 also controls and receives inputs from the peripheral components of the gaming machine 10. Further, the processor 15 communicates with external systems 30 via the I/O circuits 23*b*. Although the I/O circuits 23 may be shown as a single block, it should be appreciated that the I/O circuits 23 may include a number of different types of I/O circuits.

Figure 3:
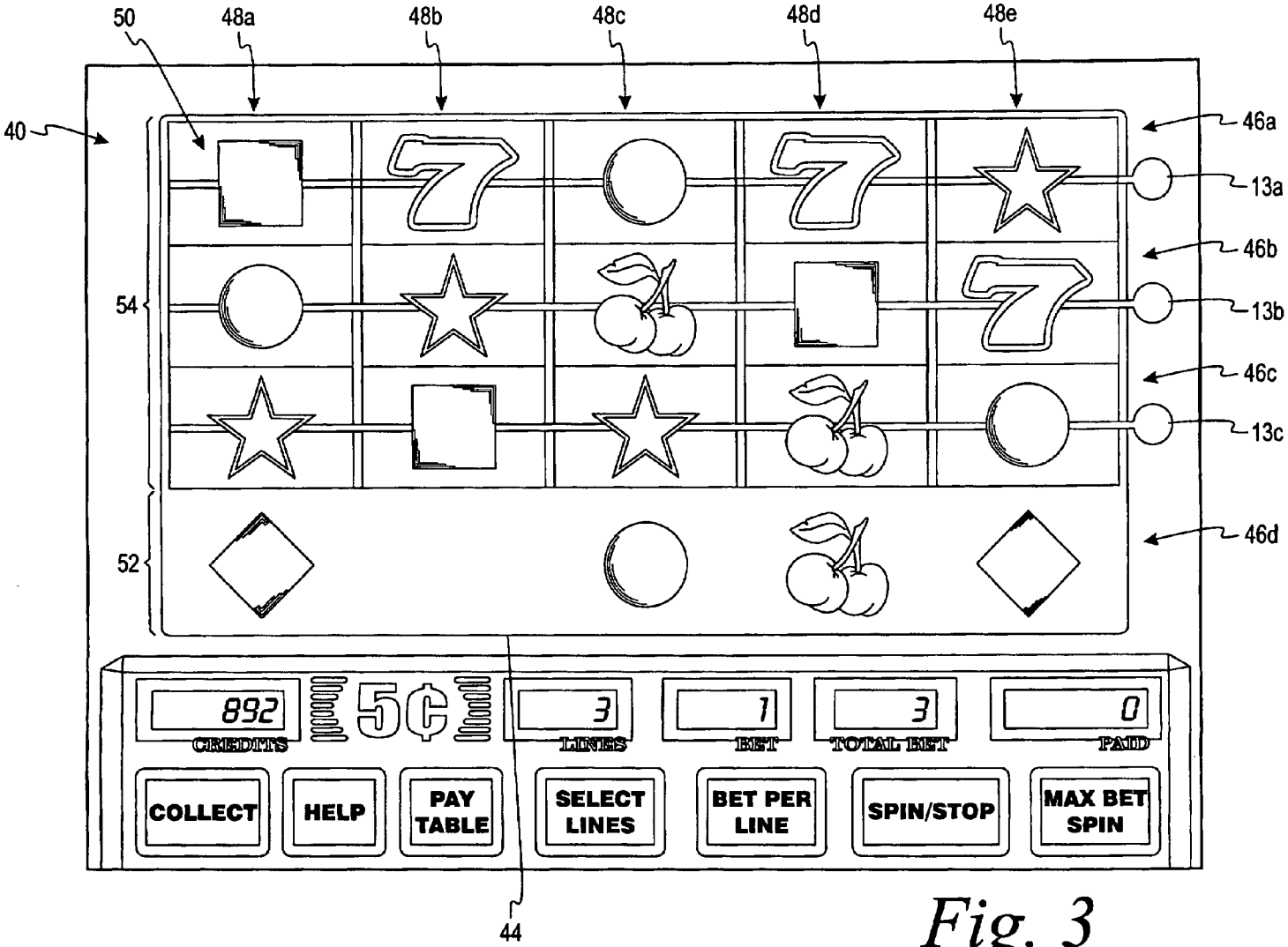
FIG. 3 is a front view of the primary display of the symbol pushing gaming machine, depicting a symbol varying portion of the game.

Turning to FIG. 3, the primary display 12 displays the symbol pushing game 40 executed by the gaming machine 10. The game 40 includes a plurality of symbols 42 arranged in an array 44. The array 44 is made up of a plurality of symbol positions 50 arranged in rows 46*a,b,c,d* and columns 48*a,b,c,d,e*. In the present embodiment, the game 40 includes three paylines 13*a,b,c* which correspond in location to the first three rows 46*a,b,c* of the array. However, the game 40 may include greater or fewer paylines 13. Preferably the array 44 is two-dimensional consisting of rows 46 and columns 48, however the array 44 may alternatively be one-dimensional (a single row 46 or column 48), as well as three-dimensional (comprising a plurality of rows 46 and columns 48 arranged in parallel planes). Some of the symbol positions 50 in the array 44 are variable positions 52, while other symbol positions 50 are pass-through positions 54. Preferably, the variable positions 52 comprise an entire row 46 or column 48 of the array 44. In this preferred embodiment, the variable positions 52 of the array 44 are located on the bottom row 46*d* of the array 44, while the pass-through positions 54 comprise the top three rows 46*a,b,c* of the array 44. The symbols 42 in the variable positions 52 are randomly varied by the processor 15 of the gaming machine 10 during each play of the game 40. The symbols 42 in the pass-through positions 54 move to an adjacent pass-through position when pushed or translated by another symbol 42, as will be described in greater detail herein.

Continuing with FIG. 3, after making a wager using the value input device 20, a player of the gaming machine 10 executes a play of the game 40 using the player input device 16. During a play of the game 40, the symbols 42 in the variable positions 52 of the array 44 are randomly varied, or "spun." The varying of the symbols 42 in the variable positions 52 may be accomplished using any number of methods well known in the art. For example, each of the variable positions 52 may comprise an individual reel of a slot game such that the reels are spun and stopped, thereby varying the symbols 42 displayed in the variable positions 52. Alternatively, the symbols 42 may be randomly varied upon the activation of a push button or other player input device 16 by the player. In this preferred embodiment, the variable positions 52 of the array 44 constantly cycle through various symbols 42 until such time that a player actuates a stop button on the player input device 16 to stop the cycling of the symbols 42. In this way, the cycling of the symbols 42 in conjunction with the pushing of the button on the player input device 16 imparts a perceived skill to the game 40 upon the player. The stopping of the symbols 42 may in fact be linked to the timing of the actuation of the button, thereby taking player skill into account, or may alternatively be random, giving only the appearance of perceived skill to the player actuating the button.

Following the actuation of the stop button, the following symbols 42 have stopped or landed in the variable positions 52, from left to right: Diamond, Blank, Circle, Cherry, Diamond. Thus, the symbol varying portion of the game 40 is complete. During the symbol varying portion of the game, only the symbols 42 in the variable positions 52 have varied while the symbols 42 in the pass-through positions 54 remain unchanged.

Figure 4:
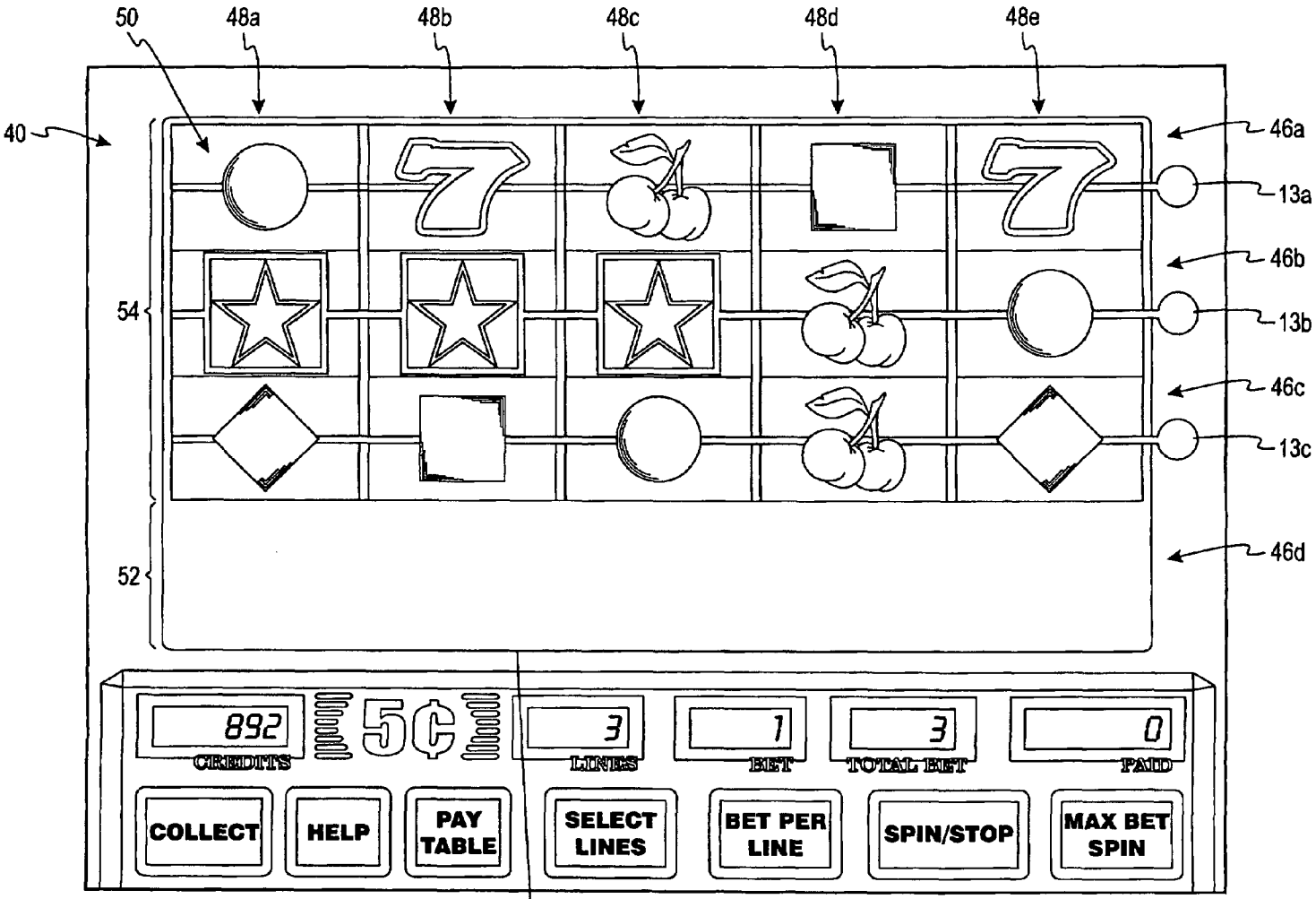
FIG. 4 is a front view of the primary display of FIG. 3, depicting a pushing mechanism of the game.

Turning now to FIG. 4, once the symbols 42 in the variable positions 52 have stopped, the symbol pushing portion of the game 40 commences. Each symbol 42 landing in one of the variable positions 52 of the array 44 moves up in its respective column 48 one position. For example, looking at the first column 48*a*, the Diamond symbol moves from the fourth, or bottom, row 46*d*, to the third row 46*c*. As the Diamond symbol moves to its new location, it translates or pushes the Star symbol in that location upward as well, such that the Star symbol is pushed from the third row 46*c* to the second row 46*b*. Similarly, the Star symbol pushes the Circle symbol from the second row 46*b* to the first row 46*a*. Finally, the Circle symbol pushes the Square symbol from the first row 46*a* out of the array 44 and off of the primary display 12. In other words, when the Diamond symbol moves from the variable position 52 to the adjacent pass-through position 54, it displaces each of the other symbols 42 in the first column 48*a* by one adjacent pass-through position 52. However, because the Square symbol was at the boundary of the array 44 (see FIG. 3), and has no adjacent pass-through position 52 in which to translate in the direction of pushing, it is removed or erased from the array 44 by nature of having been pushed out of the array 44.

Looking at the third, fourth, and fifth columns 48*c,d,e* in FIG. 4, a similar pushing mechanism occurs. In the third column 48*c*, the Circle symbol moves up one position to displace the Star symbol in the third row 46*c*, while the Star symbol moves up one position to displace the Cherry symbol in the second row 46*b*, while the Cherry symbol moves up one position to displace the Circle symbol in the first row 46*a*. The Circle symbol in the first row 46*a* disappears from the array 44 as a consequence of having been pushed out of the array 44. The same pushing mechanism occurs with the symbols 42 in the fourth and fifth columns 48*d,e*, causing the symbols 42 in the pass-through positions 52 in the fourth and fifth columns 48*d,e* to be displaced, and the Seven symbol and Star symbol in the first row 46*a* to be erased.

However, the second column 48*b* behaves differently because a blank symbol has appeared in the variable position 52 located in the second column 48*b*, fourth row 46*d*. Unlike the other symbols 42, a blank symbol does not cause a pushing mechanism to occur. Rather, when a blank symbol appears in one of the variable positions 52, it remains in the variable position 52 until the next spin, or play of the game 40. Consequently, the other symbols 42 in the pass-through positions 54 in the column 48*b* containing the blank symbol are not translated, and do not move during the instant play of the game. In this way, the blank symbols act to anchor certain columns 48 of the game 40, while symbols 42 other than blanks translate and cause the above-described pushing mechanism. Stated differently, a blank symbol is an ineligible symbol, in that it is not eligible for translation by the pushing mechanism. Conversely, all other symbols 42 other than the blank symbol are eligible symbols, as they are all eligible for translation by the pushing mechanism. Although in this preferred embodiment blank symbols are ineligible symbols while all other symbols are eligible symbols, the gaming machine 10 may be configured in a variety of ways such that certain predefined symbols appearing in the variable positions 52 are eligible, and thus activate the pushing mechanism, while other predefined symbols are ineligible and do not activate the pushing mechanism.

Continuing with FIG. 4, the primary display 12 of the gaming machine 10 is depicted following one play of the game 40, having executed the pushing mechanism feature of the game 40. Once the pushing mechanism feature of the game 40 is complete, the symbols 42 in the pass-through positions 54 are evaluated for winning combinations. As seen in FIG. 4, the pushing mechanism has caused the Star symbol in the first column 48*a*, third row 46*c* to be pushed up to the second row 46*b*, and the Star symbol in the third column 48*c*, third row 46*c* to be pushed up to the second row 46*b*. Because the second column 48*b* was unaffected during the pushing mechanism, due to the appearance of the Blank symbol in the second column 48*b* variable position 52, the result is that three Star symbols are aligned on the second payline 13*b* in the first three columns 48*a,b,c* of the second row 46*b*. The three aligned Star symbols constitute a winning combination for which a payoff is awarded to the player in accordance with the paytable. Although only one winning combination, the three aligned Star symbols, is depicted in FIG. 4, it should be understood that any number of winning combinations landing on any number of designated paylines may be awarded during as single play of the game 40. Furthermore, in addition to the pushing mechanism resulting in at least one winning combination, the gaming machine 10 may execute a cascading symbol feature as described in U.S. Patent Application Publication 2004/0033829 A1 which is hereby incorporated by reference as if fully set forth herein.

Figure 5:
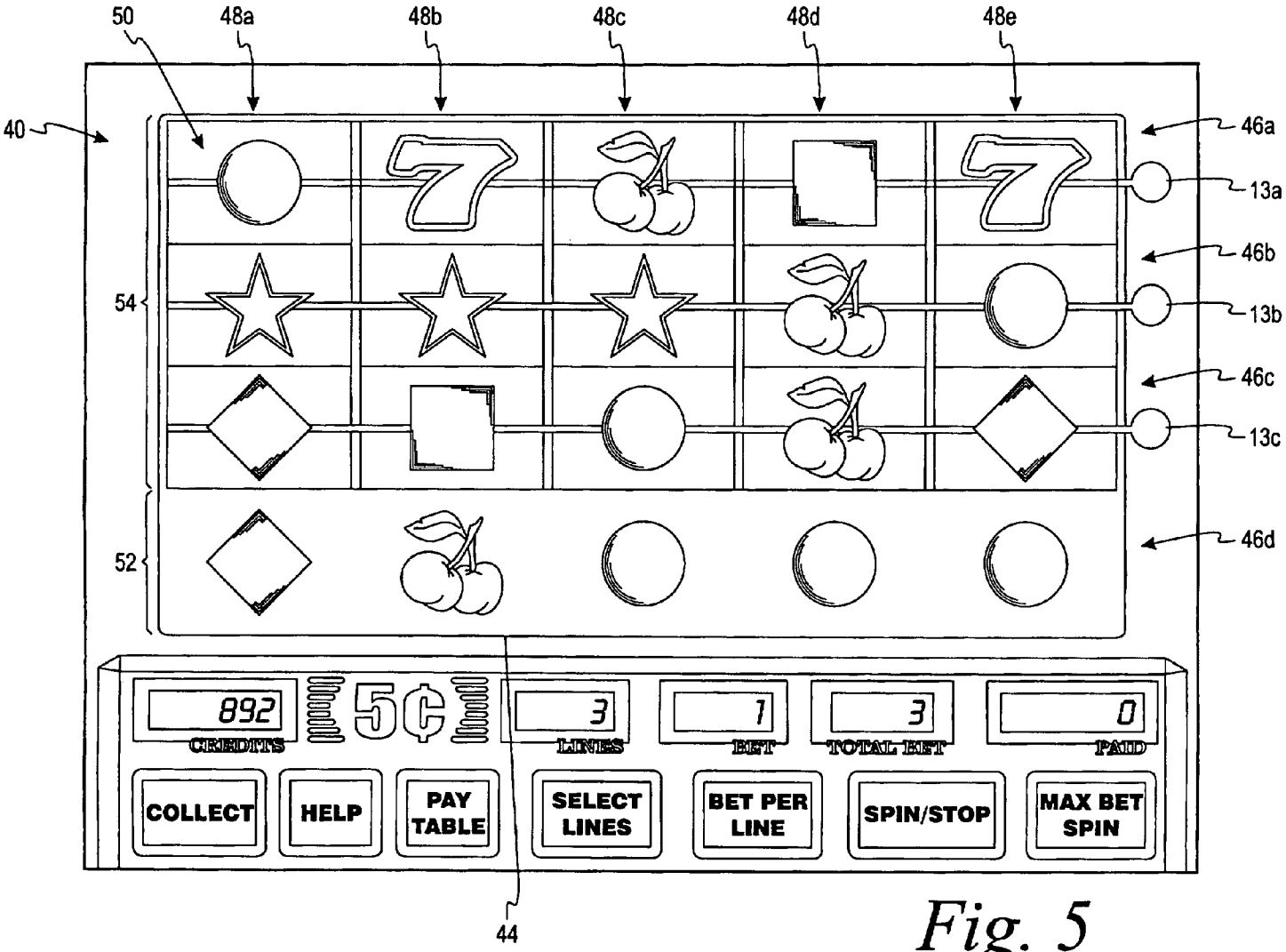
FIG. 5 is a front view of the primary display of FIG. 4, depicting a subsequent symbol varying portion of the game.

A subsequent play of the game 40 is depicted in FIG. 5. As seen, the symbols 42 in the variable positions 52 are again varied until stopped, in this embodiment, by player interaction through the player input device 16. On this play of the game 40, the symbols 42 stopping in the variable positions 52 are: Diamond, Cherry, Circle, Circle, Circle. Because no Blank symbols appeared in any of the variable positions 52, all of the symbols 42 in the variable positions 52 are eligible symbols, and thus move up one position in their respective column 48, all of the symbols 42 in the pass-through positions 54 move up one position in their respective columns 48, and all of the symbols 42 in the first row 46*a* are pushed out of the array 44 and disappear from the primary display 12.

Figure 6:
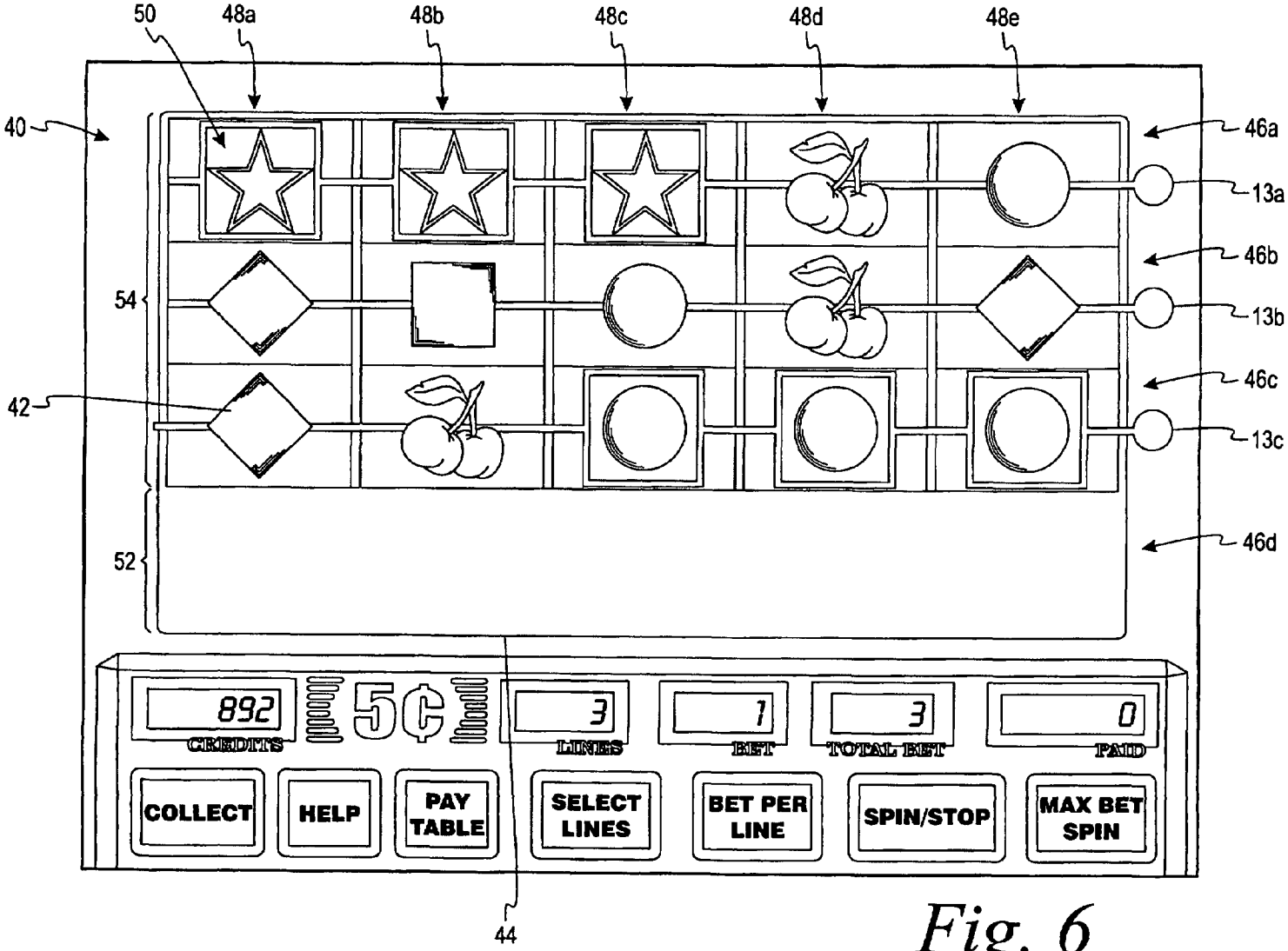
FIG. 6 is a front view of the primary display of FIG. 5, depicting a subsequent pushing mechanism of the game.

Thus, in FIG. 6, following the execution of the pushing mechanism, a new winning combination has been generated on the third payline 13*c*, in the third row 46*c* of the array 44, in the third, fourth, and fifth columns 48*c,d,e*, where the three aligned Circle symbols constitute a winning combination for which a payoff is awarded in accordance with the paytable. Furthermore, the three aligned Star symbols in first three columns 48*a,b,c* of the second row 46*b* have been pushed to the first row 46*a*. Because the three Star columns remain aligned, now on the first payline 13*a*, they again constitute a winning combination, and thus another payoff is awarded to the player for the three Star symbols, in accordance with the paytable. In this way, the pushing mechanism of the game 40 allows for certain winning combinations to recur as the combination is pushed through the array 44. In this embodiment, a winning combination is permitted to recur up to three times as it passes through the first three rows 46*c,b,a* and is pushed out of the array 44. In the illustrated embodiment, winning combinations start from the left most column 48*a* or the right most column 48*e* and span adjacent columns 48. Alternatively, winning combinations may be required to start from the left most column 48*a* as in most traditional slot games.

Although in this preferred embodiment of the game 40, all of the symbols 42 (other than ineligible Blank symbols) in the variable positions 52 are pushed during the pushing mechanism, it should be understood that various other criteria regarding eligibility for the pushing mechanism may be imposed. For example, in an alternative embodiment, only symbols 42 which constitute a winning combination while in the variable positions 52 may be pushed while symbols 42 not part of a winning combination are held in the variable positions 52 and re-spun during a subsequent play of the game 40. Furthermore, although it is preferred that the symbols 42 are pushed in a direction intersecting the alignment of the variable positions 52, alternate embodiments of the game 40 may include pushing the symbols in various directions. For example, on some plays of the game 40, symbols 42 may be pushed along rows 46 while on subsequent plays the symbols 42 may be pushed along columns 48, in either direction. Additionally, although this embodiment of the invention includes aligned variable positions 52, it should be understood that any positions 50 within the array 44 may be designated as variable positions 52, and the location(s) of the variable positions 52 may vary during subsequent plays of the game 44. In an alternate embodiment, the number and location(s) of the variable positions 52 maybe random, or player-selectable. However, it is preferred that certain symbols 42 stopping in variable positions 52 be translated out of the variable position 52 to an adjacent position 50 in the array 44, thereby causing the pushing of other symbols 42 in the array 44 in the direction of translation.

In an alternate embodiment of the invention, the variable positions 52 are located in the fourth (bottom) row 46*d* of the array 44 are constantly variable. Thus, each variable position 52 constantly cycles or "spins" through a plurality of variable symbols 42. The player playing the gaming machine 10, via the player input device 16 is provided with a stop button to stop or freeze the variable symbols 42 in the variable positions 52 so that they may then be pushed upwards in to the array 44 as described herein. Thus, in this alternative embodiment, rather than the player pressing a "Start" or "Spin" button which spins the variable symbols 42 for a predetermined time, the variable symbols 42 constantly spin and are frozen by player input 16, preferably a stop button, and pushed into the array 44 as described herein. It should be understood that the stop button may be a soft button on the touch screen of the display 14, or alternatively may be a push button on the housing 11 of the gaming machine 10. The continuously cycling symbols 42 in the variable positions 52 provides the additional excitement by producing the perceived effect that the player can stop the cycling of the symbols 42 at a desirable place.

In yet another alternate embodiment, winning combinations are only awarded from left to right through the array 44. Thus, as seen in FIG. 6, the three "Stars" combination in the first row 46*a* is a winning combination because the three stars are in the first three positions in the row 46*a*. In other words, because the combination begins on the left side of the array 44 (beginning in the first column 48*a*), it is a qualifying winning combination for which an award is awarded. Conversely, the three "Circles" combination in the third row 46*c* is a winning combination, but no award is given because the combination begins in the third column 48*c*. Thus, winning combinations which appear on the paytable are only awarded if they occur beginning in the first symbol position of each row 46. Alternatively, both left to right and right to left pays may be awarded, thus qualifying the three "Circles" combination in the third row 46*c* as a winning combination for which an award is paid.

As an additional or alternative feature, the gaming machine 10 may include a sliding feature to allow winning combinations which do not occur beginning in the first column 48*a* to slide over to the first column 48*a* in order to qualify for an award. This additional feature involves the processor 15 detecting the presence of a winning combination in any row 46 that does not begin in the first column 48*a*. For example, in FIG. 6, the three "Circle" combination is a winning combination according to the paytable which is not awarded because it begins (left to right) in the third row 48*c*. The "sliding" feature of this alternative embodiment detects the presence of the three circles winning combination and slides the three circle symbols two positions to the left. This causes the three Circles combination to qualify for an award in accordance with the paytable, and an award is awarded to the player. As the symbols slide to the left, the last two positions in the row 46*c* may either be left blank, or may be populated by the processor 15 with random symbols. As before, because blank positions do not translate or get pushed through the array 44, the blank symbols in the third row 46*c* would be filled on the next play of the game by symbols pushed up from the variable positions 52.

Figure 7:
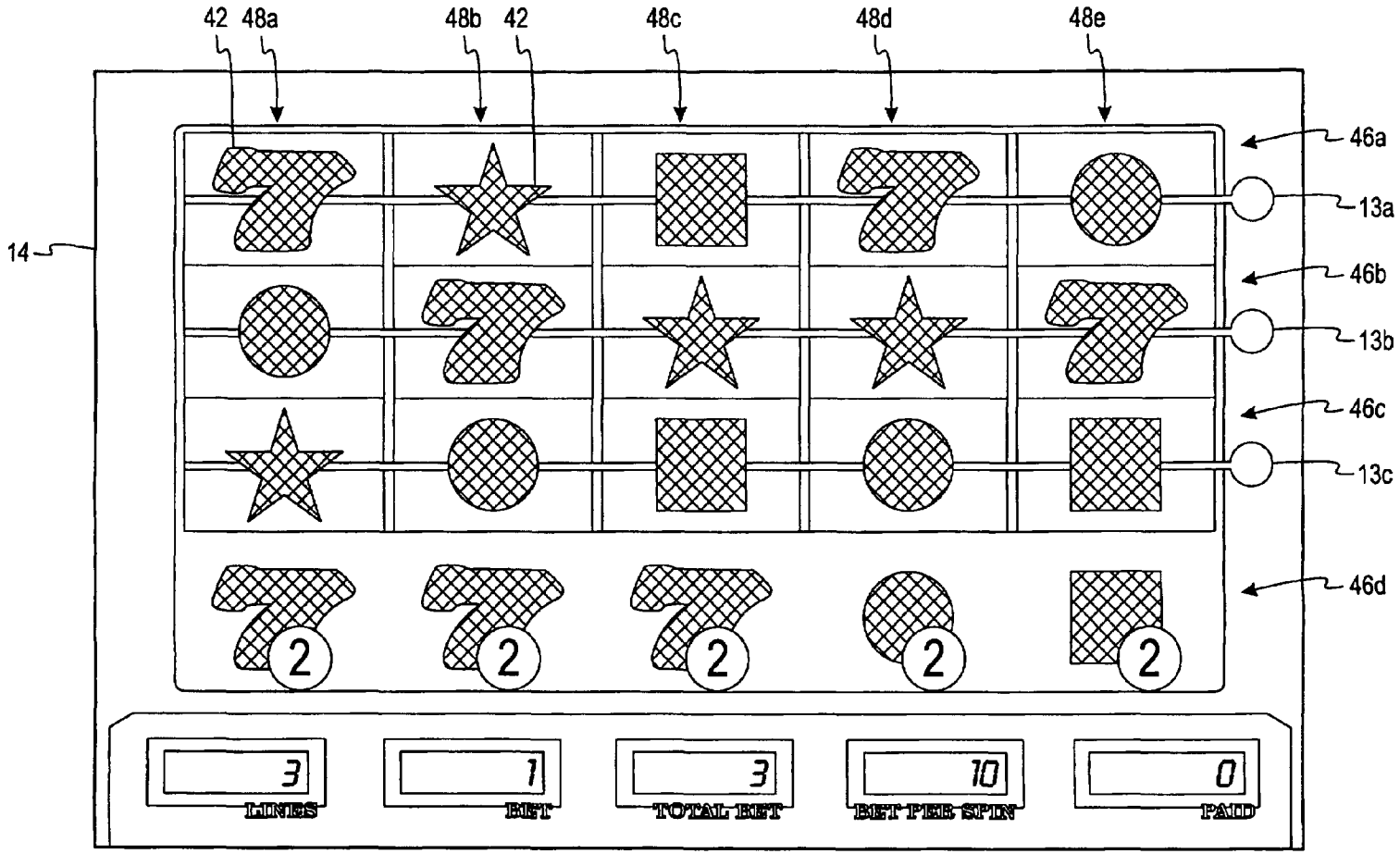
FIG. 7 is a front view of the primary display of another embodiment of the gaming machine.
Figure 8:
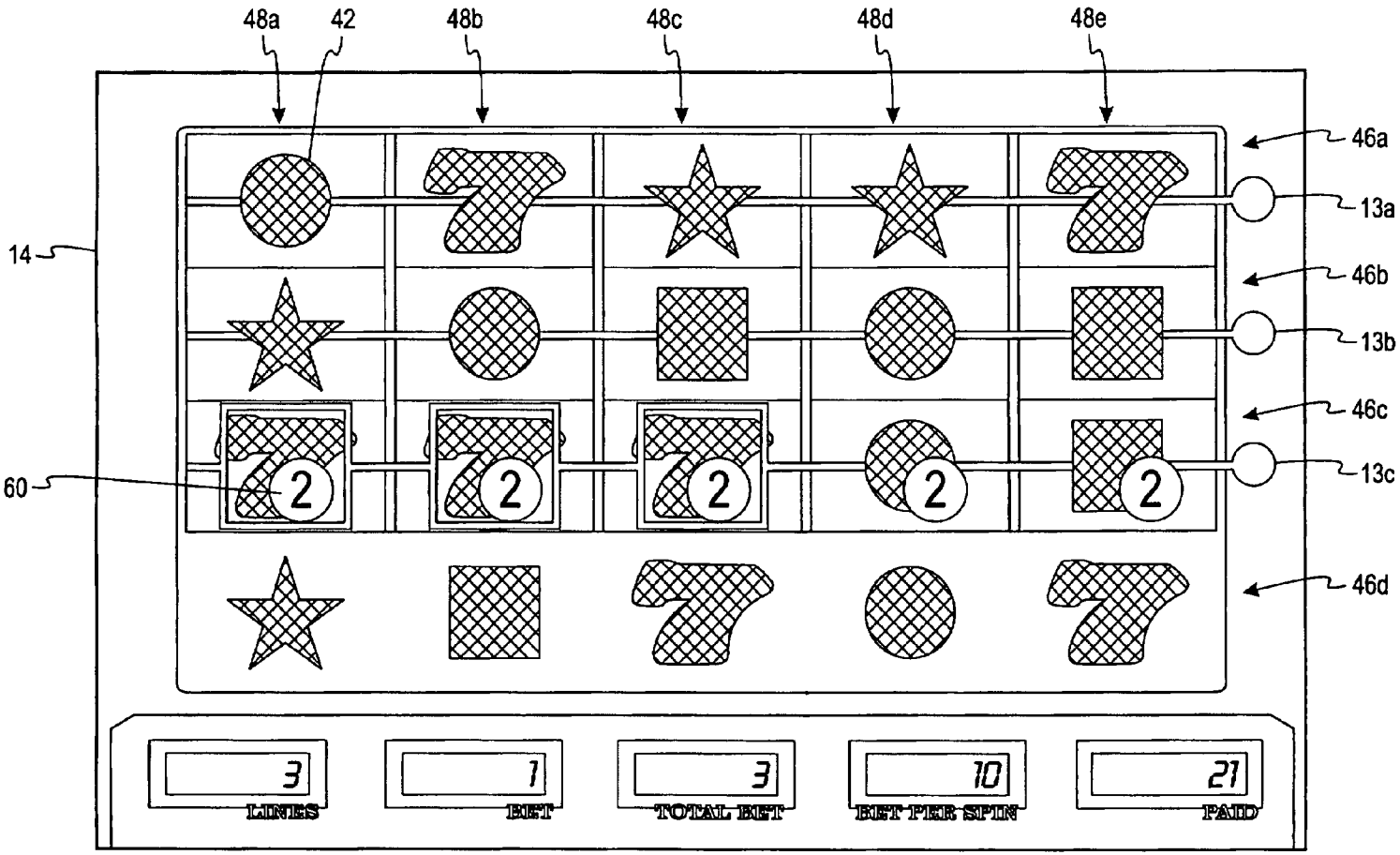
FIG. 8 is the primary display of FIG. 7 depicting a Bet Per Spin wager and award.
Figure 9:
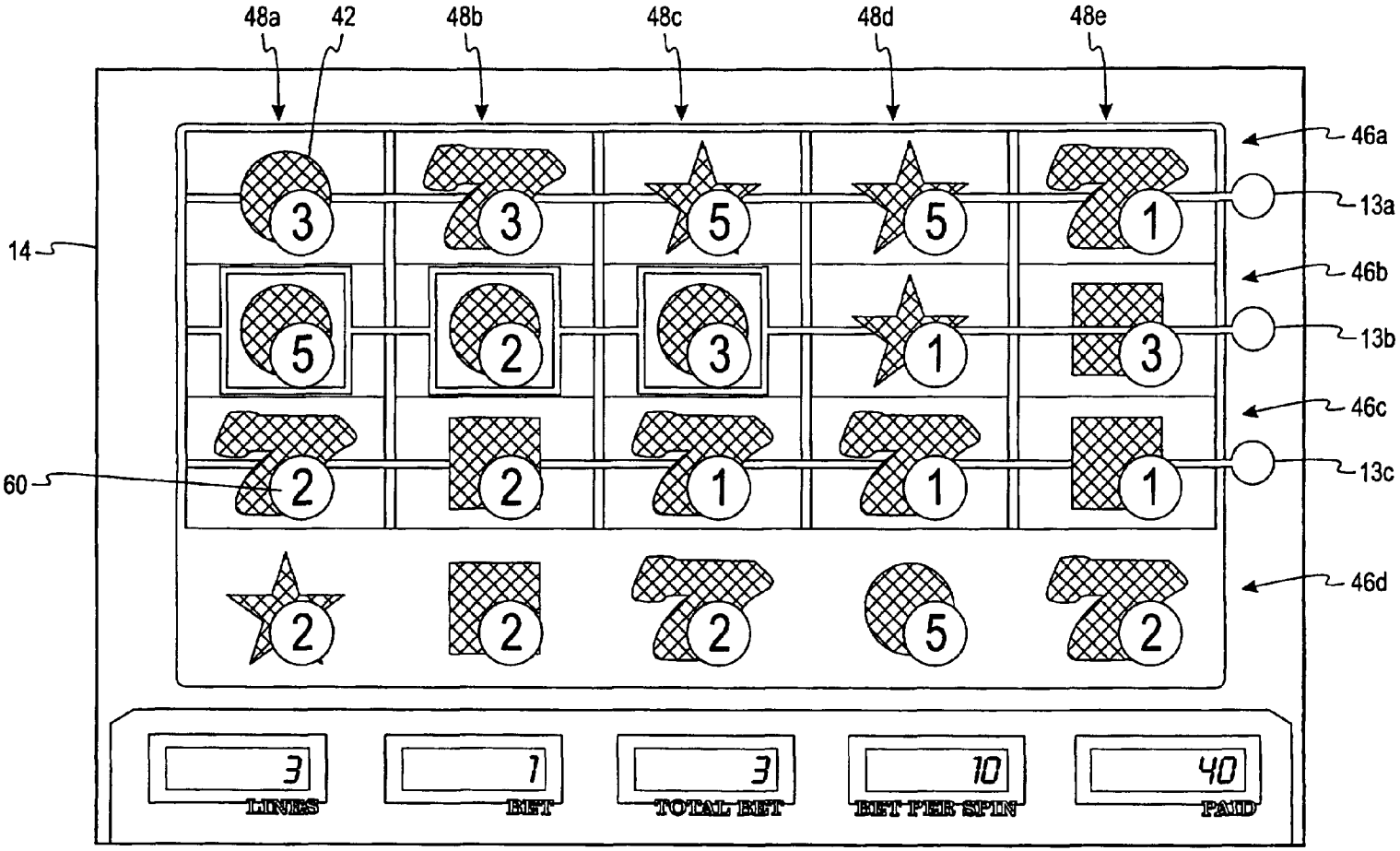
FIG. 9 is the primary display of FIG. 7 depicting an alternate Bet Per Spin wager and award.

Yet another embodiment of the gaming machine is depicted in FIGS. 7-9, which allows the player to make additional wagers on each play of the gaming machine 10. In this embodiment, the player makes an initial or primary wager on a play of the gaming machine 10, referred to as a "line bet" as described herein. However, at anytime prior to a spin or play of the game, the player may make an additional wager on that spin referred to as a "Bet Per Spin". Thus, as shown the game includes three paylines 13, so a player making a one credit line bet on all three paylines 13 wagers three credits. As seen in FIG. 7, the player has elected to make an additional Bet Per Spin wager of ten credits. The Bet Per Spin wager is divided equally between five symbols 42 in the five columns 48 and a Bet Per Spin indicator 60 is displayed next to each symbol 42 for which a Bet Per Spin wager was made. Thus in FIG. 7, each of the symbols 42 in the third row 46*c* have a "2" indicator symbolizing one fifth of the 10-credit Bet Per Spin wager placed by the player.

As seen in FIG. 8, the symbols 42 carrying the additional Bet Per Spin of "2" are pushed into the array 44 and evaluated for winning combinations. In FIG. 8, the three "Sevens" combination in the third row 46*c* constitutes a winning combination for which an award is awarded. In this embodiment, a three "Sevens" combination is awarded 15 credits according to the paytable. In addition to the basic award, the player is awarded an additional award because one or more of the symbols in the winning combination carry a Bet Per Spin wager. Thus, since all three "Seven" symbols have a "2" indicator 60 (indicating a Bet Per Spin wager made on those symbols) the player is awarded an additional award of 6 credits, two for each of the three "Seven" symbols comprising the winning combination. Thus, as seen in FIG. 8, the total award for this play of the gaming machine 10 is 21 credits: 15 credits for the three "Sevens" combination and 6 credits for the Bet Per Spin wager, indicated by the Bet Per Spin indicators 60 associated with each symbol. Thus, the Bet Per Spin wager has the effect of increasing the value of a particular symbol in the event that symbol is included in a winning combination in the array 44.

The Bet Per Spin wager can be made or altered prior to any or every spin or play of the gaming machine 10. On one spin a player may choose to make a Bet Per Spin wager of 10, as in FIGS. 7 and 8, while on a subsequent spin, the player may make a Bet Per Spin wager of 25. Thus, as seen in FIG. 9, the resulting effect may be that the array 44 is populated with symbols having Bet Per Spin indicators 70 of different values. In FIG. 9, for example, the Bet Per Spin indicators 70 vary from zero to five. Any range of Bet Per Spin indicators 70 may be used to signify any variety of Bet Per Spin wagers. If a winning combination occurs, the player is awarded the sum total of the Bet Per Spin indicators for the symbols comprising that winning combination. Therefore, in the second row 46*b* of the array 44 in FIG. 9, three "Circle" symbols constitute a winning combination for which a primary award is awarded in accordance to the paytable. However, because the three "Circle" symbols have Bet Per Spin indicators 70 of 5, 2, and 3 respectively, the player is awarded an additional award of 10 credits, which is the sum of the indicators 70 in the winning combination. The total award is the sum of the base award for the three Circle combination (in the case 30 credits) plus the sum of the Bet Per Spin indicators 60 for the three Circle symbols (in this case 10 credits), or a total of 40 credits. Thus, the Bet Per Spin wager allows the player an opportunity to increase the value of symbols in the array 44 and receive an additional award if those symbols comprise winning combinations.

The present invention provides a symbol pushing game 40 for a gaming machine 10 that has substantial advantages over traditional games. The randomization and stopping of the variable symbols 42 in the variable positions 52 provides entertainment to the player in the form of either actual or perceived skill in stopping symbols to create winning combinations. Furthermore, the pushing mechanism provides additional and greater payoff awards to player by allowing winning combinations to be pushed through the array 44, and to recur multiple times. Additionally, the mechanism of pushing some portions of the array 44 while not pushing other portions (when a Blank symbol occurs, for example) provides additional suspense and entertainment to the player in observing the translation of symbols 42 to form winning combinations. Finally, the varying of the symbols 42 in the variable positions 52 may be accomplished more rapidly then traditional slot machines, and thus more plays of the game 40 may be executed in the same period of time. Due to this faster pace of the game 40, the player is given more opportunities to win. To assist the player, the primary display 12 (or secondary display 14) of the gaming machine 10 may include a table or legend of recent wins of the game, which serves to display to a player recent winning combinations which have been awarded by the gaming machine 10. Thus the player may more readily keep track of historical performance of the game 40 during fast paced play.

Each of these embodiments and obvious variations thereof is contemplated as falling within the spirit and scope of the claimed invention, which is set forth in the following claims.

What is claimed is:

1. A gaming machine comprising:

a value input device configured to accept a physical item associated with a monetary value, the monetary value establishing a credit balance;

a player input device for receiving a wager deducted from the credit balance initiating the symbol pushing wagering game;

one or more displays for displaying the wagering game having a plurality of symbols arranged in an array, the array comprising one or more variable positions and one or more first pass-through positions, and wherein each of the one or more variable positions is associated with a predetermined one of the first pass-through positions; and a controller operative to:

i. randomly vary a first symbol in each of the one or more variable positions, while holding any second symbol in each of the first pass-through positions;

ii. translate the first symbol, if any, from each of the one or more variable positions to the associated predetermined one of the first pass-through positions; and iii. remove, from the predetermined one of the first pass-through positions, any second symbol being held in the predetermined one of the first pass-through positions, in response to the first symbol appearing in the associated variable position.

2. The gaming machine of claim 1, wherein any second symbol being held in the predetermined one of the first pass-through positions is translated from the predetermined one of the first pass-through positions to a predetermined one of one or more second pass-through positions.

3. The gaming machine of claim 2 wherein the first and second symbols are translated simultaneously.

4. The gaming machine of claim 1, wherein the varying of the first symbols results in a first one of the variable positions having a non-blank symbol and a second one of the variable positions having a blank symbol, wherein the non-blank symbol is translated to the associated first pass-through position, and wherein the blank symbol remains in the second one of the variable positions until a non-blank symbol appears in the second one of the variable positions.

5. The gaming machine of claim 1, wherein the controller continuously randomly varies the first symbol in each of the one or more variable positions until a stop input is received from a player of the gaming machine.

6. A gaming machine for executing a symbol pushing wagering game comprising:

a value input device configured to accept a physical item associated with a monetary value, the monetary value establishing a credit balance;

a player input device for receiving a wager deducted from the credit balance initiating the symbol pushing wagering game;

one or more displays for displaying the symbol pushing wagering game, the one or more displays having a plurality of symbols arranged in an array, the array arranged in a plurality of intersecting rows and columns, the array comprising a plurality of variable positions and a plurality of pass-through positions, each of the variable positions being associated with a predetermined one of the pass-through positions, each of the variable and pass-through positions containing a symbol; and a controller operative to randomly vary each symbol in the variable positions while holding each symbol in the pass-through positions, and translate the symbol from each variable position to each predetermined one of the pass-through positions.

7. The gaming machine of claim 6 wherein, when each symbol translates from a variable position to the predetermined pass-through position, the symbol being held in the predetermined pass-through position is translated to another predetermined pass-through position.

8. The gaming machine of claim 6 wherein all of the variable positions in the array are located in one row.

9. The gaming machine of claim 6, wherein the symbols comprise eligible symbols and ineligible symbols, wherein only eligible symbols in the variable positions are translated to the pass-through positions.

10. A method of conducting a symbol pushing wagering game on a gaming machine, the method comprising:

receiving an input to an value input device configured to accept a physical item associated with a monetary value, the monetary value establishing a credit balance;

receiving a primary wager deducted from the credit balance initiating the symbol pushing wagering game from a player via a player input device;

displaying a wagering game, via one or more displays, the game having a plurality of symbols arranged in an array, the array comprising a plurality of intersecting rows and columns, the array comprising a plurality of variable positions and a plurality of pass-through positions, each of the variable positions being associated with a predetermined pass-through position, each variable position and each pass-through position containing a symbol;

randomly varying, by the processor, the symbols contained in the variable positions while holding the symbols contained in the pass-through positions;

moving the symbol from each variable position to each predetermined pass-through position; and awarding, by the processor, a primary payoff for any resulting winning combinations of symbols.

11. The method of claim 10 wherein the symbols comprise eligible symbols and ineligible symbols.

12. The method of claim 11, wherein only eligible symbols are moved from the variable positions.

13. The method of claim 10, further comprising evaluating the symbols in the pass-through positions, but not the symbols in the variable positions, for winning symbol combinations after moving the symbols, and wherein the primary payoff is based on the evaluation of only the symbols in the pass-through positions.

14. The method of claim 13, wherein each removed symbol is pushed to another predetermined pass-through position in the array.

15. The method of claim 10, further comprising the step of displacing each symbol in a pass-through position by a predetermined number of positions along the array in the direction of movement.

16. The method of claim 10, wherein the pass-through positions within the array are fixed in position and number, throughout previous, current, and subsequent gaming sessions.

17. The method of claim 10, further comprising receiving a secondary wager and associating an added value related to the secondary wager with the symbols in the variable positions.

18. The method of claim 17, further comprising awarding a secondary payoff comprising the added value of the symbols included in the resulting winning combinations.

19. The method of claim 10, wherein all of the variable positions are located in either one row or one column of the array.

20. The method of claim 16, wherein the symbol in any pass-through position varies by moving into another predetermined pass-through position and being replaced by a symbol moving from one of a variable position and a pass-through position.

21. The method of claim 19 further comprising the step of erasing symbols occupying pass-through positions located in the top row of the array.

* * * * *